US010415231B1

(12) United States Patent
Pramov

(10) Patent No.: US 10,415,231 B1
(45) Date of Patent: Sep. 17, 2019

(54) MODULAR GEODESIC DOME CONSTRUCTION

(71) Applicant: Ivan Pramov, Sioux Falls, SD (US)

(72) Inventor: Ivan Pramov, Sioux Falls, SD (US)

( * ) Notice: Subject to any disclaimer, the term of this patent is extended or adjusted under 35 U.S.C. 154(b) by 0 days.

(21) Appl. No.: 15/951,805

(22) Filed: Apr. 12, 2018

(51) Int. Cl.
*E04B 1/32* (2006.01)
*E04B 1/343* (2006.01)

(52) U.S. Cl.
CPC ..... *E04B 1/3211* (2013.01); *E04B 1/34321* (2013.01); *E04B 2001/3276* (2013.01); *E04B 2001/3288* (2013.01)

(58) Field of Classification Search
CPC ..... E04B 1/3211; E04B 7/102; E04B 2001/3276; E04B 2001/3241; E04B 2001/3288; E04B 2001/3294; E04B 7/105; Y10S 52/10
See application file for complete search history.

(56) References Cited

U.S. PATENT DOCUMENTS 3,908,975 A 9/1975 Bryant
3,925,940 A 12/1975 O'Connell, Jr.
3,968,808 A 7/1976 Zeigler
3,990,195 A 11/1976 Gunther
4,263,758 A 4/1981 Seaich
4,488,392 A * 12/1984 Pearcey ..... E04B 1/3211 264/32
4,491,437 A * 1/1985 Schwartz ..... E04B 1/3211 403/172
5,873,206 A 2/1999 Roberts
6,295,785 B1 10/2001 Hermann
6,658,800 B2 12/2003 Monson
8,752,340 B1 * 6/2014 Hartman ..... E04B 1/3211 52/80.1
8,820,006 B2 9/2014 Zook
9,103,110 B1 * 8/2015 Gerber ..... E04B 1/3211
9,506,240 B1 * 11/2016 Winter ..... E04B 1/3211
2007/0163185 A1 7/2007 Morley
2012/0247035 A1 * 10/2012 Zook ..... E04B 1/3211 52/81.3
2012/0260583 A1 * 10/2012 Bischoff ..... E04B 1/3211 52/81.1

* cited by examiner

*Primary Examiner* — Gisele D Ford

(57) ABSTRACT

A modular geodesic dome construction simultaneously optimizes vertex positioning to be equidistant from a central point and minimizes a number of uniquely shaped triangular panels utilized in construction. The dome construction includes a plurality of triangular panels being coupled together along sides of the triangular panels forming a geodesic polyhedron structure. Each side of each of the triangular panels has a length corresponding to an associated one of only five length factors times a radius of the geodesic polyhedron structure. Additionally, the five distinct shapes of the triangular panels are either isosceles or equilateral triangles.

17 Claims, 7 Drawing Sheets

MODULAR GEODESIC DOME CONSTRUCTION

CROSS-REFERENCE TO RELATED APPLICATIONS

Not Applicable.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to geodesic dome constructions and more particularly pertains to a new geodesic dome construction for simultaneously optimizing vertex positioning to be equidistant from a central point and minimizing a number of uniquely shaped triangular panels utilized in construction.

BRIEF SUMMARY OF THE INVENTION

An embodiment of the disclosure meets the needs presented above by generally comprising a plurality of triangular panels being coupled together along sides of the triangular panels forming a geodesic polyhedron structure. Each side of each of the triangular panels has a length corresponding to an associated one of only five length factors times a radius of the geodesic polyhedron structure.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
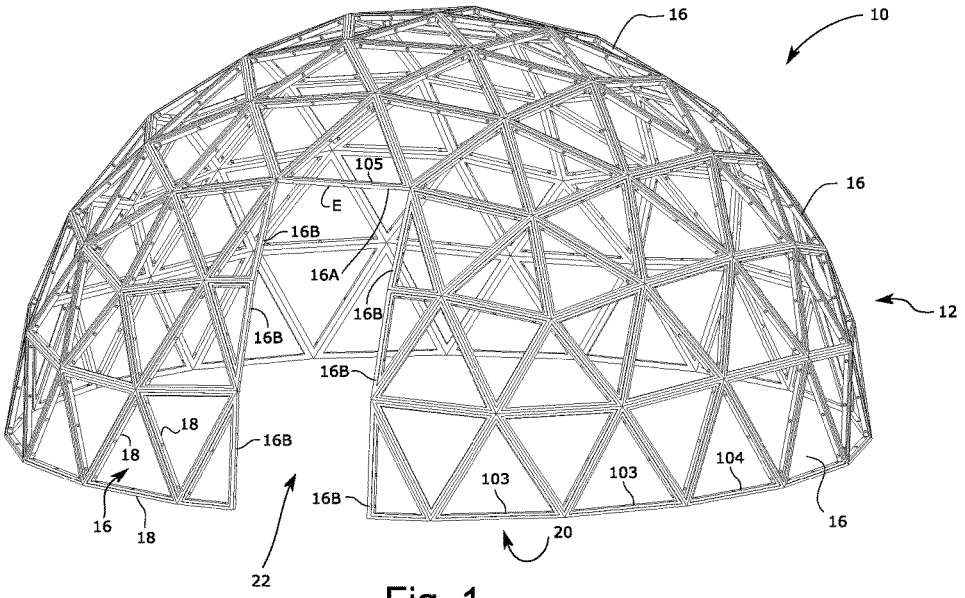
FIG. 1 is a top front side perspective view of a modular geodesic dome construction according to an embodiment of the disclosure.
Figure 2:
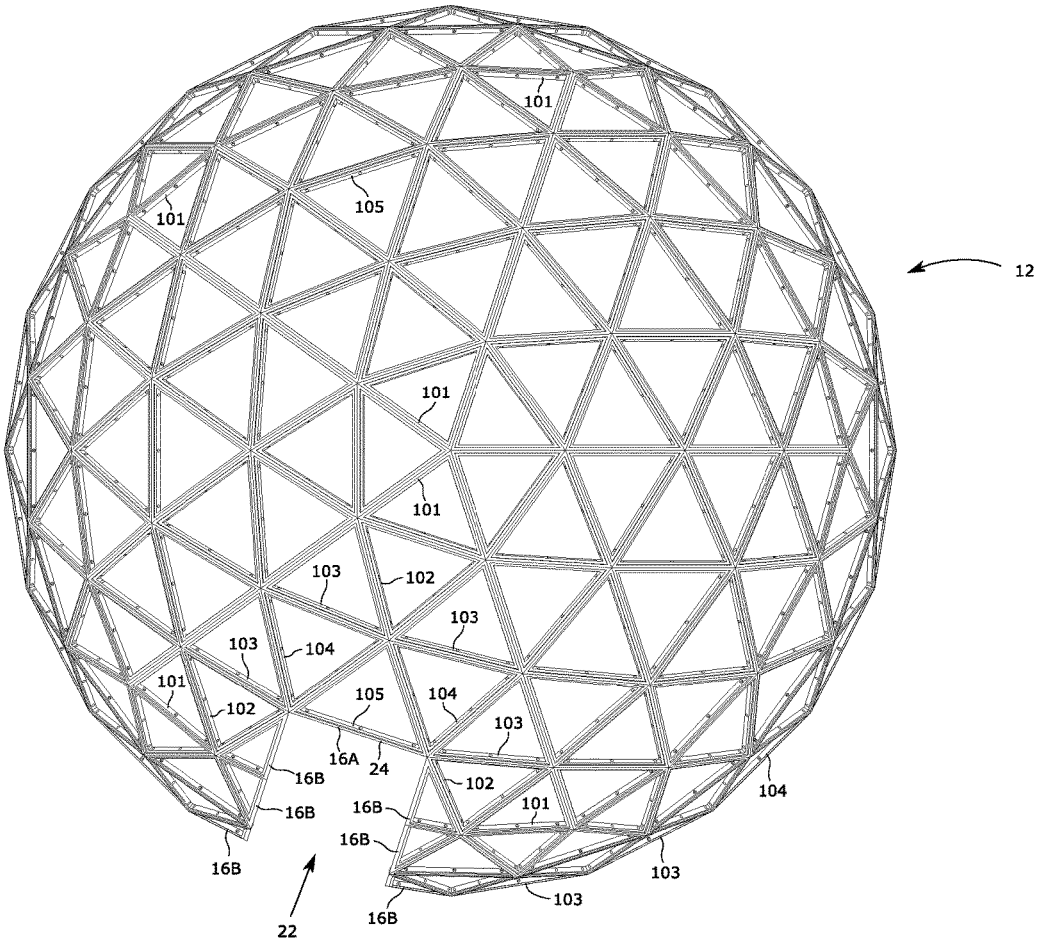
FIG. 2 is a top view of an embodiment of the disclosure.

With reference now to the drawings, and in particular to FIGS. 1 through 7 thereof, a new geodesic dome construction embodying the principles and concepts of an embodiment of the disclosure and generally designated by the reference numeral 10 will be described.

Figure 3:
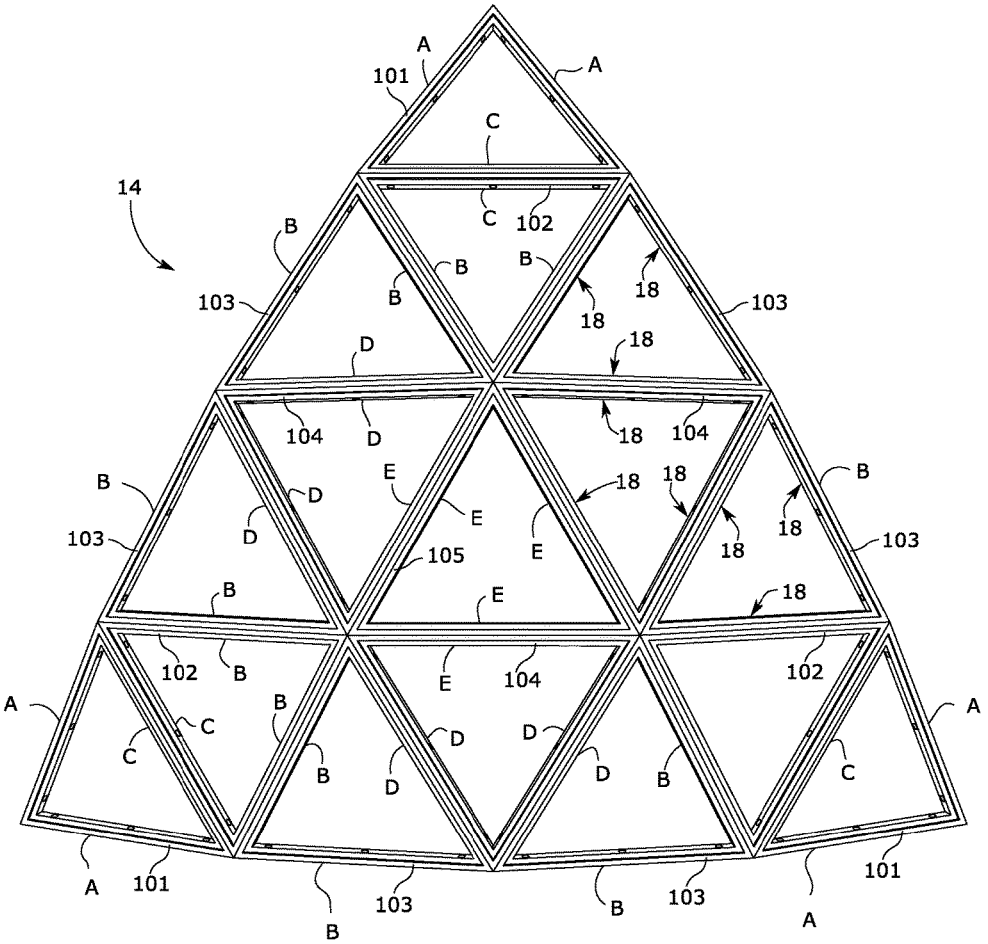
FIG. 3 is a front view of a spherical geodesic icosahedron triangle of an embodiment of the disclosure.

As best illustrated in FIGS. 1 through 7, the modular geodesic dome construction 10 generally comprises a geodesic polyhedron structure 12. The geodesic polyhedron structure 12 is substantially hemispherical based on a convex regular icosahedron, which is a polyhedron with twenty equilateral triangle faces with five meeting at each of twelve vertices. A principle polyhedral triangle is any one of the plane equilateral triangles which forms the face of a regular polyhedron. For the purpose of optimizing the substantially hemispherical shape, i.e. positioning of vertices equidistant from a center point of the shape, each principle polyhedral triangle is altered from being planar to define a spherical geodesic icosahedron triangle 14, as shown in FIG. 3, while incorporating only five different triangular panel shapes 16. Each of the sides 18 of each of the triangular panel shapes 16 has a length determined by an associated length factor multiplied by a radius of the geodesic polyhedron structure 12. There are only five length factors and the resulting triangular panel shapes 16 are either isosceles or equilateral as more fully described below.

A plurality of the triangular panels 16 is coupled together forming the substantially hemispherical portion of the geodesic polyhedron structure 12. Each side 18 of each of the triangular panels 16 has a length corresponding to an associated length factor times the radius of the geodesic polyhedron structure 12. The associated length factor of each of the sides 18 of the triangular panels 16 consists of one of a length factor A equaling 0.2602174968, a length factor B equaling 0.2915741874, a length factor C equaling 0.3033037472, a length factor D equaling 0.3128689301, and a length factor E equaling 0.3249196962. These length factors are rounded similarly to the tenth digit. However, it would be understood that the length factors could be rounded to fewer digits while still adhering to the intent of the present invention. Each triangular panel 16 has a total shape defined by a combination of associated length factors for each side 18 of the triangular panel 16 such that each unique triangular panel 16 can be identified generally by the specific combination of length factors. The distinct shape for each triangular panels 16 consists of one of the following: AAC 101, BBC 102, BBD 103, DDE 104, and EEE 105.

The triangular panels 16 are joined together as shown generally throughout the drawing figures to form sections of the overall geodesic polyhedron structure 12 corresponding to the positioning and joining of spherical geodesic icosahedron triangle 14. Each triangular panel 16 is provided with connection holes 72 the position of which may be standardized to facilitate assembly of the triangular panels 16 to form the geodesic polyhedron structure 12. When fully assembled, the geodesic polyhedron structure 12 is substantially hemispherical defining a substantially circular planar bottom edge 20 of the geodesic polyhedron structure 12. The bottom edge 20 would further define, without any breaks, an icosagon. Vertices of each of the triangular panels 16 forming the geodesic polyhedron structure 12 are equidistant from a central point of the geodesic polyhedron structure 12.

An entryway 22 may be defined in the geodesic polyhedron structure 12. The entryway 22 may of course be formed anywhere in the geodesic polyhedron structure by truncating any of the sides 18 of any of the triangular panels 16 as desired. However, within the teaching of the present invention, the entryway 22 is positioned adjacent to an unaltered one of the triangular panels 16A and a plurality of truncated triangles 16B. The truncated triangular panels 16B still form triangles but are an exception to the five distinct triangles which form the geodesic polyhedron structure 12. At least one side of each of the truncated triangular panels 16B corresponds to one of the five length factors and more specifically to either the length factor B or the length factor D. A width of the entryway 22 is equal to the length factor E times the radius of the geodesic polyhedron structure 12. A top edge 24 of the entryway 22 is defined by the side 18 of one of the triangular panels 16 having a shape corresponding to combination EEE. At least two vertices of each of the truncated triangular panels 16B are equally distant from the central point of the geodesic polyhedron structure 12 as the vertices of the triangular panels 16 forming the geodesic polyhedron structure 12.

Figure 4:
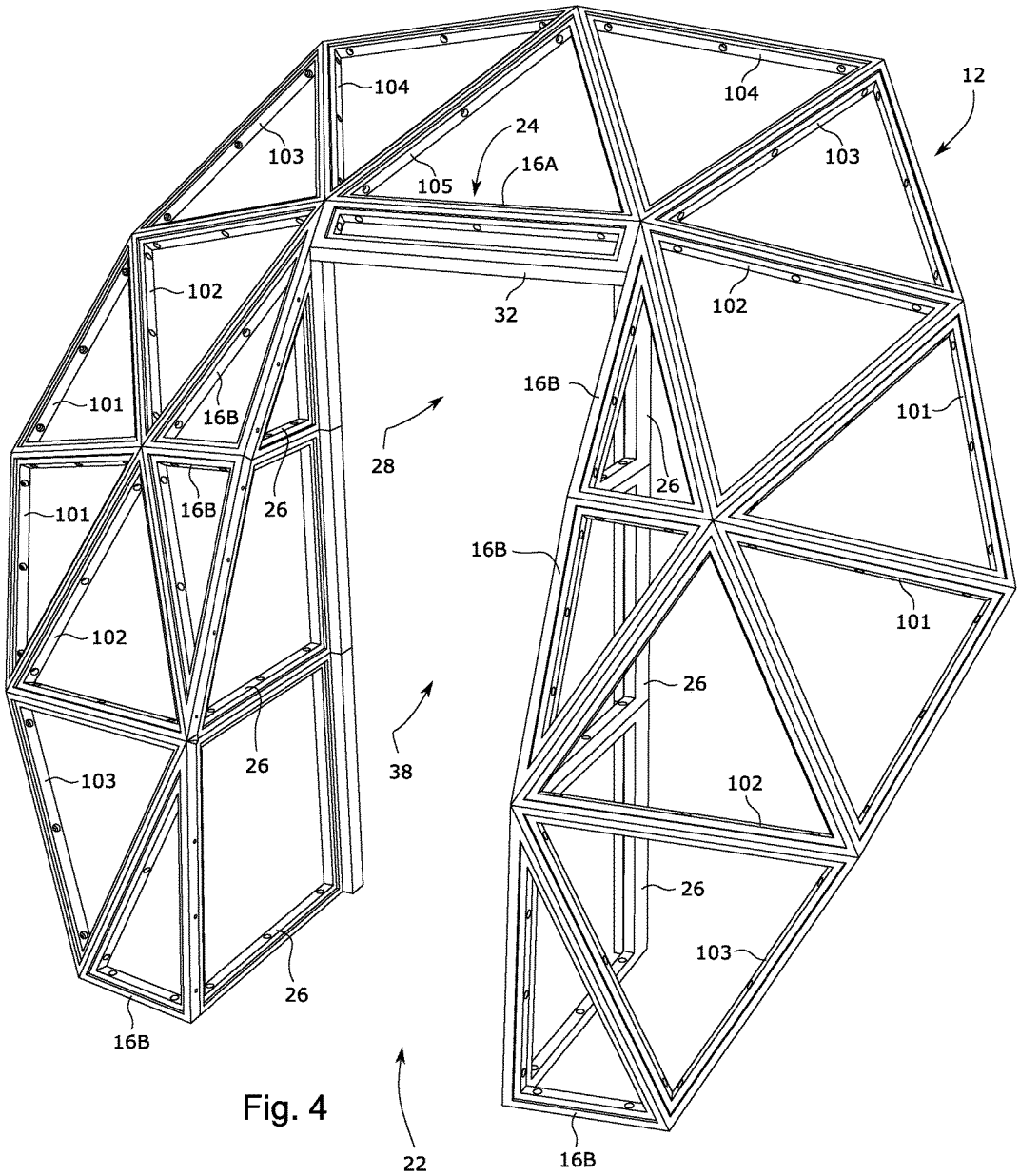
FIG. 4 is a top front perspective detailed view of an inwardly extending entryway of an embodiment of the disclosure.
Figure 5:
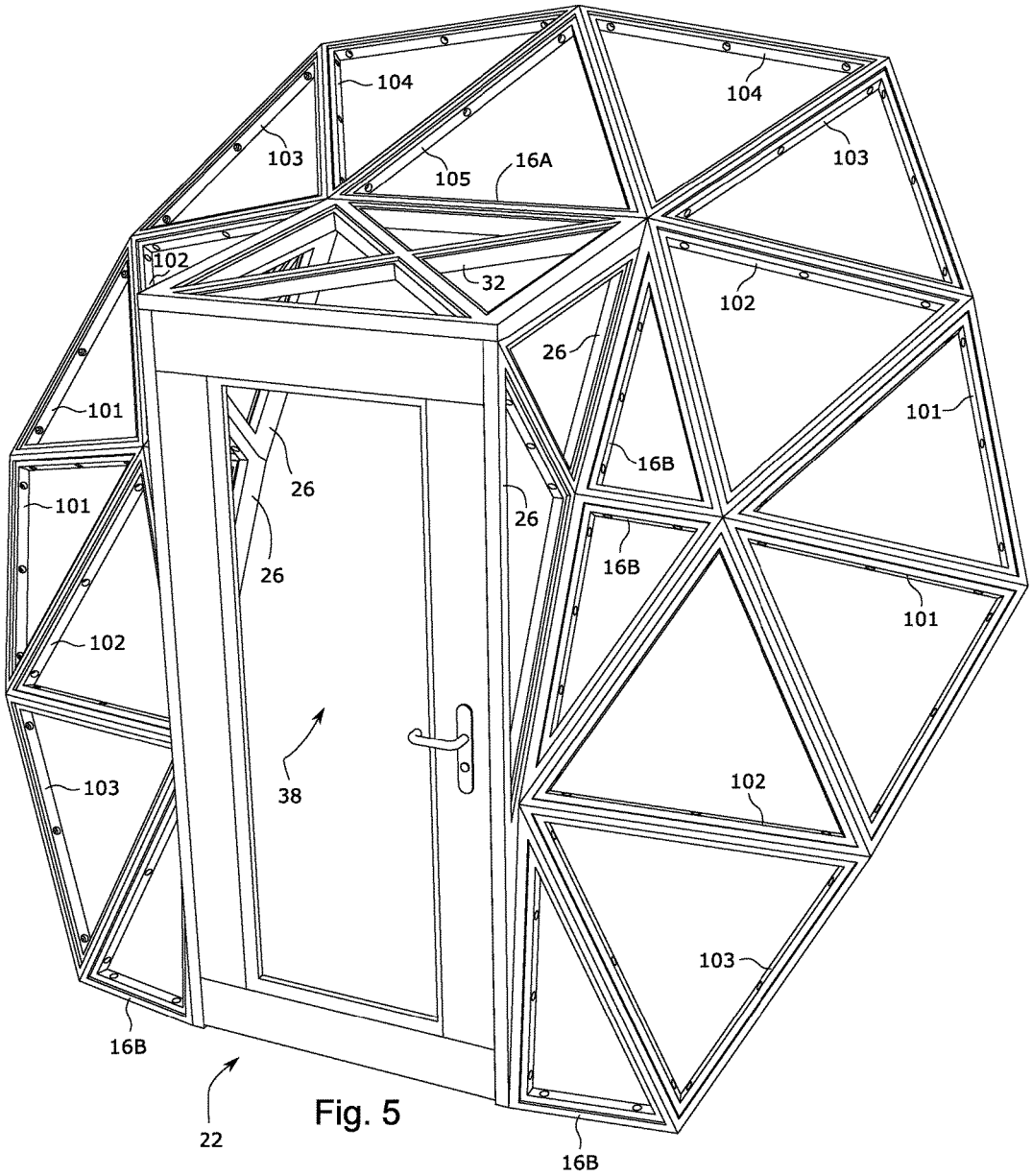
FIG. 5 is a top front perspective detailed view of an outwardly extending entryway of an embodiment of the disclosure.

A plurality of entryway side panels 26 is coupled to the geodesic polyhedron structure 12. Each of the entryway side panels 26 is typically positioned planar and perpendicular to the planar bottom edge 20 of the geodesic polyhedron structure 12. The entryway side panels 26 may extend inwardly into the interior of the geodesic polyhedron structure 12, as shown in FIG. 4, or extend outwardly away from an interior 28 of the geodesic polyhedron structure 12, as shown in FIG. 5. A header panel 32 may be attached to and extend between entryway side panels 26 on opposite sides of the entryway 22. The entryway side panels 26 and header 32 provide for a doorway 38. The doorway 38 may be of a standard size depending on the radius of the geodesic polyhedron structure 12 or by way of truncating triangular panels 16 as needed to produce the desired size for the entryway 22.

Figure 6:
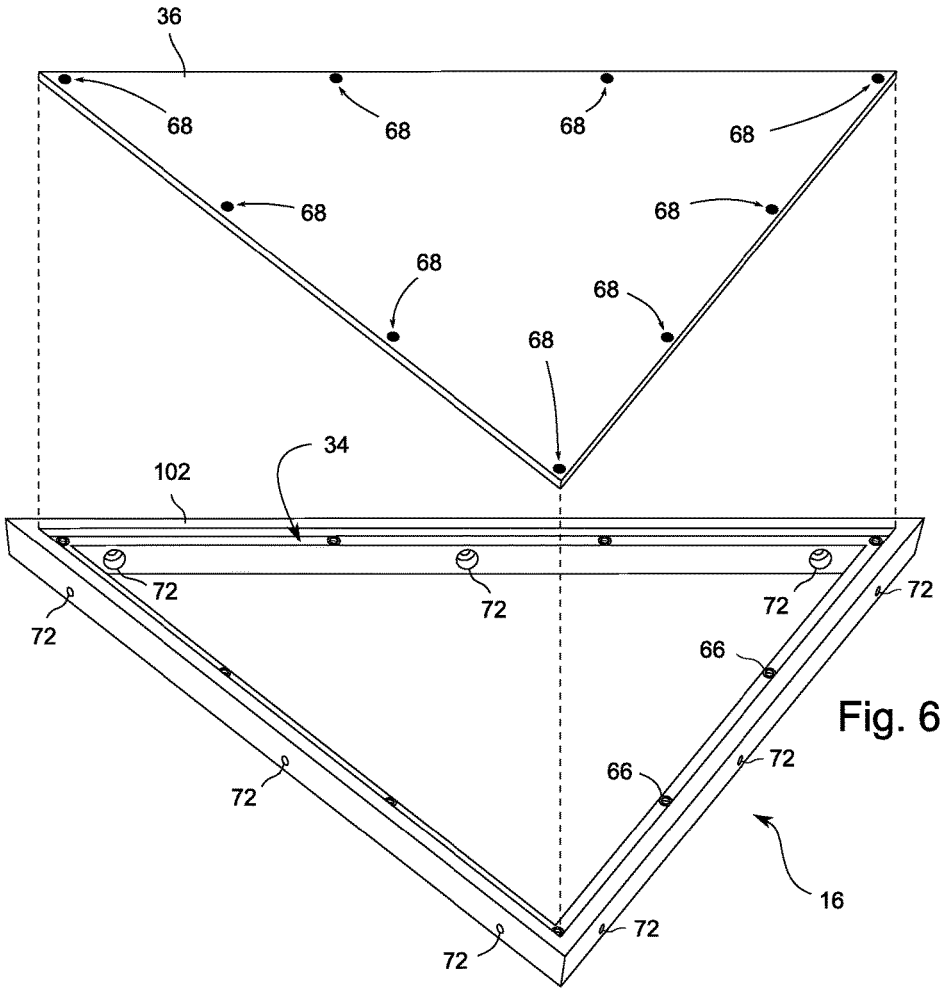
FIG. 6 is a perspective detailed view of a triangular panel of an embodiment of the disclosure.
Figure 7:
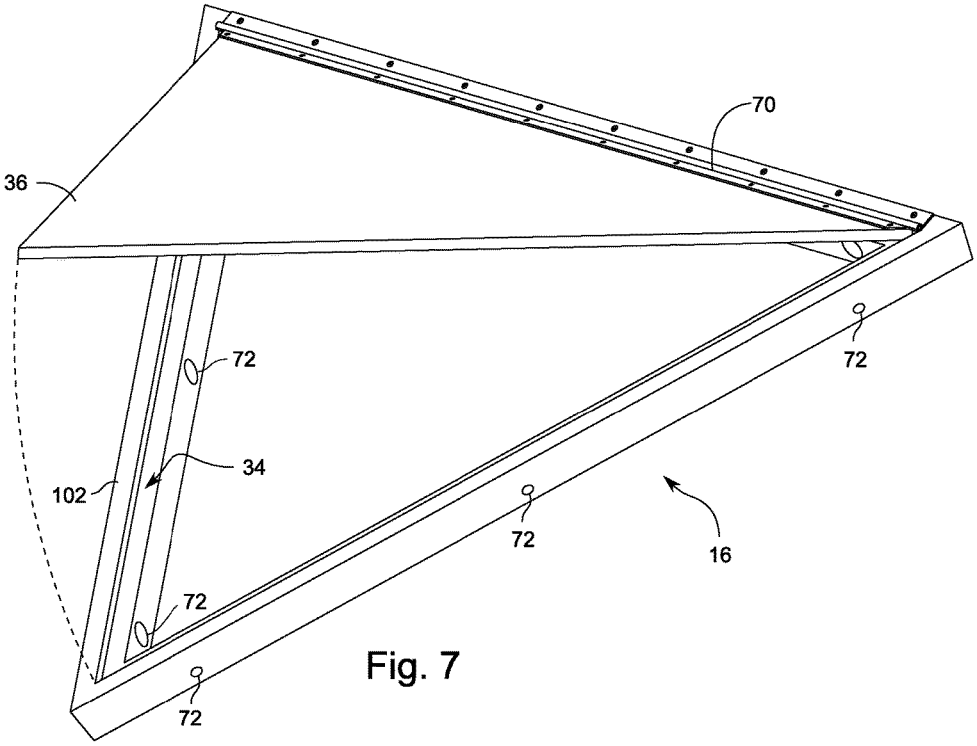
FIG. 7 is a perspective detailed view of a triangular panel of an embodiment of the disclosure.

As shown in FIGS. 6 and 7, each of the triangular panels 16 has a recessed area 34 to allow for an insert 36. The insert 36 may be opaque, translucent, or transparent and constructed of a suitable building material coupled to the triangular panel 16. The insert 36 may have a plurality of apertures 68 such that fasteners 66 may be used to secure the insert 36 to the triangular panel 16 as seen in FIG. 6. The insert 36 may also be solid or provide for either a single opening or multiple apertures such as a screen or the like. The triangular panels 16 as assembled provide for a framework for attachment of various types of materials or devices as desired. The insert 36 may have an opening or be pivotally coupled to the triangular panel 16 by a hinge 70, as seen in FIG. 7, to allow for opening of the insert 36. The geodesic polyhedron structure 12 may be anchored to the ground or another supporting structure. For purposes of building the geodesic polyhedron structure 12, each of the triangular panels 16 may be provided with the holes 72 facilitating attachment to adjacently positioned triangular panels 16, inserts 36, anchoring devices, or the like.

In use, the adherence to the length factors and shapes of the triangular panels 16 provides for reduced production costs and modularity combined with optimized approximation of spherical structure. The invention also provides for no scalene triangles except as may be employed for the entryway 22. The geodesic polyhedron structure 12 may be scaled as desired and employed for various structures including dwellings, storage, amusement, or any other desired purpose.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A geodesic dome construction comprising a plurality of triangular panels being coupled together along sides of said triangular panels forming a geodesic polyhedron structure, wherein each said side of each of said triangular panels has a length corresponding to an associated one of only five length factors times a radius of the geodesic polyhedron structure;

wherein said five length factors comprise a length factor A equaling 0.2602174968, a length factor B equaling 0.2915741874, a length factor C equaling 0.3033037472, a length factor D equaling 0.3128689301, and a length factor E equaling 0.3249196962; and each of said triangular panels not immediately adjacent to an entryway is either an isosceles triangular panel or an equilateral triangular panel.

2. The construction of claim 1, further comprising vertices of each of said triangular panels forming said geodesic polyhedron structure being equidistant from a central point of said geodesic polyhedron structure.

3. A geodesic dome construction comprising:

a plurality of triangular panels being coupled together along sides of said triangular panels forming a geodesic polyhedron structure, wherein each said side of each of said triangular panels has a length corresponding to an associated one of five length factors times a radius of the geodesic polyhedron structure; and wherein said five length factors comprise a length factor A equaling 0.2602174968, a length factor B equaling 0.2915741874, a length factor C equaling 0.3033037472, a length factor D equaling 0.3128689301, and a length factor E equaling 0.3249196962.

4. A geodesic dome construction comprising a plurality of triangular panels being coupled together forming a portion of a geodesic polyhedron structure, wherein each side of each of said triangular panels has a length corresponding to an associated length factor times a radius of the geodesic polyhedron structure, said associated length factor of each of said sides of said triangular panels consisting of one of a length factor A equaling 0.2602174968, a length factor B equaling 0.2915741874, a length factor C equaling 0.3033037472, a length factor D equaling 0.3128689301, and a length factor E equaling 0.3249196962.

5. The construction of claim 4, further comprising each said triangular panel having a shape defined by a combination of associated length factors for each said side of said triangular panel, wherein said combination consists of one of the following: AAC, BBC, BBD, DDE, and EEE.

6. The construction of claim 4, further comprising an entryway defined in said geodesic polyhedron structure, said entryway being positioned adjacent to a one of said triangular panels and a plurality of truncated ones said triangular panels wherein at least one side of each of said truncated triangular panels corresponds to one of said length factor A, length factor B, length factor C, length factor D, and length factor E.

7. The construction of claim 4, further comprising vertices of each of said triangular panels forming said geodesic polyhedron structure being equidistant from a central point of said geodesic polyhedron structure.

8. The construction of claim 6, further comprising:

vertices of each of said triangular panels forming said geodesic polyhedron structure being equidistant from a central point of said geodesic polyhedron structure; and wherein at least two vertices of each of said truncated ones of said triangular panels are equally distant from said central point as said vertices of said triangular panels forming said geodesic polyhedron structure.

9. The construction of claim 6, further comprising said at least one side of each of said truncated triangular panels corresponding to one of said factor B and said length factor D.

10. The construction of claim 6, further comprising a width of said entryway being equal to length factor E times said radius of said geodesic polyhedron structure.

11. The construction of claim 10, further comprising a top edge of said entryway being defined by said side of one of said primary triangular panels having a shape corresponding to combination EEE.

12. The construction of claim 6, further comprising:

said geodesic polyhedron structure being hemispherical defining a planar bottom of said geodesic polyhedron structure; and a plurality of entryway side panels coupled to said geodesic polyhedron structure, each of said entryway side panels being planar and perpendicular to said planar bottom of said geodesic polyhedron structure.

13. The construction of said 12, further comprising said entryway side panels extending outwardly away from an interior of said geodesic polyhedron structure.

14. The construction of claim 12, further comprising said entryway side panels extending inwardly into an interior of said geodesic polyhedron structure.

15. The construction of claim 4 further comprising:

each said triangular panel having a shape defined by a combination of associated length factors for each said side of said triangular panel, wherein said combination consists of one of the following: AAC, BBC, BBD, DDE, and EEE, said geodesic polyhedron structure being hemispherical defining a planar bottom of said geodesic polyhedron structure;

an entryway defined in said geodesic polyhedron structure, said entryway being positioned adjacent to a one of said triangular panels and a plurality of truncated ones said triangular panels wherein at least one side of each of said truncated triangular panels corresponding to one of said factor B and said length factor D, a width of said entryway being equal to length factor E times said radius of said geodesic polyhedron structure, a top edge of said entryway being defined by said side of one of said primary triangular panels having a shape corresponding to combination EEE;

vertices of each of said triangular panels forming said geodesic polyhedron structure being equidistant from a central point of said geodesic polyhedron structure;

wherein at least two vertices of each of said truncated ones of said triangular panels are equally distant from said central point as said vertices of said triangular panels forming said geodesic polyhedron structure; and a plurality of entryway side panels coupled to said geodesic polyhedron structure, each of said entryway side panels being planar and perpendicular to said planar bottom of said geodesic polyhedron structure.

16. The construction of said 15, further comprising said entryway side panels extending outwardly away from an interior of said geodesic polyhedron structure.

17. The construction of claim 15, further comprising said entryway side panels extending inwardly into an interior of said geodesic polyhedron structure.

* * * * *